US012091928B2

(12) United States Patent
Hognestad et al.

(10) Patent No.: US 12,091,928 B2
(45) Date of Patent: Sep. 17, 2024

(54) TUBING HANGER DEPLOYMENT TOOL

(71) Applicant: Simple Tools AS, Bryne (NO)

(72) Inventors: Kåre Hognestad, Bryne (NO); Hasse Herland, Hafrsfjord (NO); Kenneth Opheim, Stavanger (NO)

(73) Assignee: Simple Tools AS, Bryne (NO)

( * ) Notice: Subject to any disclaimer, the term of this patent is extended or adjusted under 35 U.S.C. 154(b) by 0 days.

(21) Appl. No.: 18/271,729

(22) PCT Filed: Feb. 22, 2022

(86) PCT No.: PCT/NO2022/050045
§ 371 (c)(1),
(2) Date: Jul. 11, 2023

(87) PCT Pub. No.: WO2022/182243
PCT Pub. Date: Sep. 1, 2022

(65) Prior Publication Data

US 2024/0060381 A1 Feb. 22, 2024

(30) Foreign Application Priority Data

Feb. 23, 2021 (NO) ..... 20210236

(51) Int. Cl.
*E21B 33/04* (2006.01)
*E21B 21/08* (2006.01)
*E21B 33/06* (2006.01)

(52) U.S. Cl.
CPC ..... *E21B 33/04* (2013.01); *E21B 21/08* (2013.01); *E21B 33/06* (2013.01)

(58) Field of Classification Search
CPC ..... E21B 33/04; E21B 33/06; E21B 21/08
See application file for complete search history.

(56) References Cited

U.S. PATENT DOCUMENTS 4,811,784 A * 3/1989 Theiss ..... E21B 33/04 166/208
5,029,643 A * 7/1991 Winslow ..... E21B 33/1291 166/131

(Continued)

FOREIGN PATENT DOCUMENTS

WO 2011126591 10/2011
WO 2016182449 11/2016

OTHER PUBLICATIONS

Norwegian Search Report for No. 20210236, dated Aug. 19, 2021.

(Continued)

*Primary Examiner* — Aaron L Lembo
(74) *Attorney, Agent, or Firm* — Andrus Intellectual Property Law, LLP

(57) ABSTRACT

A tool, tool assembly and method are for operating a well component. The tool being has a bore and one or more inlets at a first portion of the tool; a set of one or more inlet lines extending along tool from the inlets to one or more inlet line terminations at a lower end of the tool; one or more inlets at a second portion of the tool; a set of one or more inlet lines extending from the one or more inlets at the second portion to one or more inlet line terminations at the lower end; one or more outlets having outlet valves; and one or more return lines extending from one or more return line terminations at the lower end to the one or more outlets. The inlet and return line terminations mate with correspondingly fitting inlets and outlets, respectively, on a well component.

17 Claims, 9 Drawing Sheets

(56) References Cited

U.S. PATENT DOCUMENTS

| | | | | |
|---|---|---|---|---|
| 6,536,529 | B1 | 3/2003 | Kerr et al. | |
| 7,306,042 | B2 * | 12/2007 | Bansal | E21B 21/08 166/105 |
| 7,395,866 | B2 | 7/2008 | Milberger et al. | |
| 8,668,004 | B2 | 3/2014 | June et al. | |
| 2005/0217845 | A1 | 10/2005 | McGuire | |
| 2022/0298889 | A1 * | 9/2022 | Falk | E21B 21/08 |

OTHER PUBLICATIONS

International Search Report and the Written Opinion for PCT/NO2022/050045, dated Jun. 9, 2022.
International Preliminary Report on Patentability and the Response to the Written Opinion for PCT/NO2022/050045, dated Oct. 26, 2022 and Oct. 7, 2022.

* cited by examiner

Section D-D

Detail F

TUBING HANGER DEPLOYMENT TOOL

CROSS-REFERENCE TO RELATED APPLICATIONS

This application is the U.S. national stage application of International Application PCT/NO2022/050045, filed Feb. 22, 2022, which international application was published on Sep. 1, 2022, as International Publication WO 2022/182243 in the English language. The International Application claims priority of Norwegian Patent Application No. 20210236, filed Feb. 23, 2021. The international application and Norwegian application are both incorporated herein by reference, in entirety.

FIELD

The invention relates to a tool for operating a well component. More specifically invention relates to a the tool being arranged for deployment on a pipe string, the tool being formed with a central, axially extending bore and comprising a first portion and a second portion, the first portion being arranged above the second portion in a position of use; one or more inlets at the first portion of the tool; and a first set of one or more inlet lines extending axially along tool from the one or more inlets at the first portion of the tool and to one or more inlet line terminations at a lower end of the tool. The invention also relates to a tool assembly in which such a tool is included as well as a method for operating the tool assembly.

BACKGROUND

A Tubing Hanger (TH) is a wellhead component that is used in well drilling operations or well work over operations. As the name implies, it hangs and supports the tubing string with the topmost tubing joint in the wellhead or Christmas tree and helps in sealing the tubing string inside the tubing spool. The TH also defines the connection between surface control and instrumentation in the well.

During installation of the TH, the TH is latched to a tubing hanger running tool (THRT), the THRT typically including hydraulic actuators for locking the TH to a tubing spool or wellhead and for unlatching the THRT from the tubing hanger. Hydraulic fluids to operate these actuators have commonly been supplied through an umbilical from topside, the umbilical normally including hydraulic lines and power and communication lines. Such umbilicals are very costly, and their cost increasing with the length of the umbilical. Storage of such umbilicals consumes large amounts of deck space, and their handling constitutes a significant HSE risk. Normally, due to the need for integrating umbilical connections into the tubing string, this also adds significant length to the THRT and associated equipment, entailing a need for designated tubing hanger handling tools (THHT) topside for lifting the TH into the drill floor. Thereafter, the THHT is replaced by the THRT before running the equipment into the well. It is therefore desirable to avoid the use of umbilicals, or at least to use slimmer umbilicals, during installation of well equipment, such as tubing, tubing hangers and bore protectors.

The problems of umbilical cost and complicated handling and storage are well known, and several solutions have been proposed to remedy at least some of the drawbacks.

WO2016182449A1 proposes to provide a local subsea source of hydraulic fluid included in an internal control module connected between the tubing string and THRT, while control and communication with topside is provided by means of a slimmer umbilical communicating with the control module via the BOP or riser. Though this solution eliminates the need for hydraulic lines in the umbilical, it still requires the provision of a local hydraulic source, a communication module and a slim communication/power connection to the surface.

In contrast, WO 2011/126591 suggests using feed-throughs in the BOP to drive hydraulic actuators in a THRT. However, the functionality is limited as the connection can only be used to run hydraulic actuators in the THRT in one direction, i.e. to latch/lock the tubing hanger to the spool. For unlatching THRT from the TH, it must be mechanically released from the TH before pulling the pipe string with the THRT out of the well.

U.S. Pat. No. 8,668,004 B2 discloses system including a subsurface safety valve (SSV) biased toward a closed position and configured to open by application of hydraulic pressure. The system also includes a tubing hanger running tool (THRT), including a conduit in fluid communication with the SSV, and a pressure release valve fluidly coupled to the conduit. The pressure release valve is configured to maintain sufficient hydraulic pressure within the conduit to hold the SSV in an open position while the pressure release valve is in a closed position.

The invention has for its object to remedy or to reduce at least one of the drawbacks of the prior art, or at least provide a useful alternative to prior art.

The object is achieved through features, which are specified in the description below and in the claims that follow.

The invention is defined by the independent patent claims. The dependent claims define advantageous embodiments of the invention.

In a first aspect, the invention relates to a tool for operating a well component, the tool being arranged for well deployment on a pipe string and for being positioned in a central, axially extending cavity of a blowout preventer (BOP), the tool being formed with a central, axially extending bore and comprising:

- a first portion and a second portion, the first portion being arranged above the second portion in a position of use;
- one or more inlets at the first portion of the tool;
- a first set of one or more inlet lines extending axially along tool from the one or more inlets at the first portion of the tool and to one or more inlet line terminations at a lower end of the tool;
- one or more inlets at the second portion of the tool;
- a second set of one or more inlet lines extending from the one or more inlets at the second portion of the tool and to one or more inlet line terminations at the lower end of the tool;
- one or more outlets provided with outlet valves; and
- one or more return lines extending from one or more return line terminations at the lower end of the tool to the one or more outlets, wherein the inlet and return line terminations are adapted to mate with correspondingly fitting inlets and outlets, respectively, on a well component, wherein
- the first and second portions are separated by a bypass mandrel having a slick outer surface; and
- the outlet valves ensure that fluids can only flow into the well component from the inlet lines and out from the well component and into the return lines of the tool.

The well component may e.g. be a tubing hanger running tool (THRT), a tubing hanger emergency retrieving tool (THERT), a bore protector or other hydraulically operated equipment to be installed and/or later uninstalled in/from a well. It should be noted that by "well component" is meant any component used in connection with petroleum wells, and that the component does not necessarily have to be placed or placeable downhole. The well component may, in some embodiments, be placed in or near a wellhead.

In a preferred embodiment the one or more outlets may be in flow communication with the central, axially extending bore of the tool. This provides a simple way of handling the return fluid from operation of one or more hydraulic actuators in the well component without the need of additional outputs and modifications of the tool and system as such. An alternative to letting the return flow into the central bore of the tool would be to let one or more return lines extend on the outside of the tool and to a position above the BOP, when installed in a well, or to take the return through a designated feedthrough in the BOP. As mentioned above, the valves provided at the outlets, which may be check valves or other fluid control valves, ensure that the hydraulics can only flow in one direction; from inlet to return lines through well component. The fluid control valves, such as check valves, may be designed to let the return from flow the well component once a pre-determined pressure threshold is reached. In certain embodiments, such as when letting the return flow into the central bore of the tool, the pressure threshold may be set to a few bar, where the back-pressure on the check valves from the central bore may be controllable from topside. The pressure acting on the check valves will be the differential pressure between the return flow and the pressure in the central bore of the tool.

In one embodiment the one or more of the inlets at the first and/or second portion of the tool may be provided with an inlet flow restricting member such as a burst disc and/or a check valve. Such a flow restricting member may ensure that an inlet line, and thereby a hydraulic function in the well component, is not inadvertently activated at pressures below an activation pressure threshold. Different Inlet valves, such as check valves, and/or burst discs at the same portion of the tool may also be designed to be activated at different pressure thresholds so that different hydraulic functions in the well component may be activated independently of each other.

In one embodiment one or more of the inlets at the first and/or second portion of the tool may be provided with a filter for filtering hydraulic fluid. This may be advantageous to ensure that the hydraulics used to activate different hydraulic functions on the well components has sufficient cleanliness.

In one embodiment the one or more inlets at the second portion of the tool and one more of the outlets are provided in a common injection mandrel. This may be beneficial for ease of retrofit of the tool to an existing pipe string and for ease of maintenance.

In addition or as an alternative the one or more inlets at the first portion of the tool may be provided in a carrier clamp, implying that the carrier clamp may then optionally also be provided with valves and/or burst discs and/or hydraulic cleaning filters, as discussed above. Similarly to an injection mandrel, a carrier clamp will also ease retrofit and general assembly of the tool, while simplifying maintenance. In a preferred embodiment, the tool may comprise a crossover sub for connecting the remainder of the tool to a pipe string, and wherein the carrier clamp is clamped to the crossover sub.

The bypass mandrel may enable inlet lines, and optionally outlines lines if the outlets do not extend into the central bore of the tool, to extend along the tool inside the bypass mandrel so that they may be protected inside the wall of the mandrel while the tool maintains a slick and preferably circularly shaped outer circumference. A slick outer surface may make it easier to create a seal around the tool as will be explained in the following.

In one embodiment the tool may be provided with one or more reservoirs with clean fluid. The reservoir(s) may be in the form of a piston, tank, bladder etc, and it may be used to store clean fluid from surface for later use downhole. The reservoir can be an integral part of the tool (first portion, second portion or both) or attached as a separate item. The reservoir can be a liquid divider, but also a separate item/function. The purpose of the reservoir of clean fluid is to provide a closed hydraulic portion of the total hydraulic circuit used to operate the downhole component, such as the THRT. The reservoir may typically be provided on the tool between one or more of the inlets and the outlets, where a partition in the form of a floating piston, a bladder or similar separates the reservoir of clean fluid from the "dirty" fluid entering to tool from the outside, meaning that the dirty/contaminated fluid will push the clean fluid to operate the downhole component. In this way, it is ensured that the hydraulic fluid used to operate the downhole component is unused and clean, improving the reliability of the activation of the downhole component. Many such wellbore components only need to be operated once, implying that the clean fluid only needs to be used once. Fluid entering the tool from the outside, i.e. from a cavity in the BOP, as will be explained in the following, will typically be regarded as dirty/contaminated.

In a second aspect, the invention relates to a tool assembly comprising:

- a tool according to the first aspect of the invention.
- a well component to which the tool is connected, the inlet and return line terminations at the lower end of the tool being mated with correspondingly fitting inlets and outlets, respectively, on the well component, the well component including one or more hydraulic actuators controllable via the inlet and return lines;
- a pipe string to which the tool is connected;
- a blowout preventer (BOP) in which the tool is positioned in a central, axially extending cavity, the BOP comprising:
  - two or more rams moveable between a retracted position and an active position, the two or more rams being provided with a axial distance therebetween; and
  - two or more feedthroughs for providing fluid communication with the central cavity of the BOP from the outside of the tool assembly; wherein a first feedthrough is provided between the first and second rams and a second feedthrough is provided below the second ram; and wherein:
- the tool is positioned in the central cavity of the BOP so that a first ram, when in its active position, is sealing against the tool or pipe string above the one or more inlets at the first portion of the tool, and a second ram, when in its active position, is sealing against the tool between the first and second portions of the tool.

With the tool assembly according to the invention it is possible to pressurize two different cavities around the tool assembly by means of feedthroughs in a BOP. The feedthroughs may in some embodiments be existing feedthroughs in the BOP such as connections for kill and choke lines, whereby no additional modifications need to be made to the BOP. In other embodiments, new, designated feedthroughs may be made specifically for the purpose. Since the tool has different inlets adapted to be positioned in the two different cavities, the two different feedthroughs may be used to activate different hydraulic actuators on the well component. This may be used to control actuators that must not be run at the same time, such as installing a TH and unlatching a THRT from the TH, are operated independently of each other. Since the hydraulic fluids only flow in one direction into these actuators/cylinders, the tool and tool assembly according to the invention gives more flexibility in the hydraulic operation of a well component compared to the prior art aiming to avoid the use of hydraulic umbilicals.

In one embodiment, two or more rams may include an annular ram and a pipe ram. The annular ram is sometimes simply referred to as an "annular". It should however be noted that any ram or seal adapted to engage with the tool or pipe string to seal and thereby create such sealed cavities in the BOP may be used.

In one embodiment, as already exemplified above, the well component may include a tubing hanger running tool (THRT), and wherein the downhole tool assembly is adapted to install and uninstall a tubing hanger (TH) in and from a well and to unlatch and latch the THRT from and to TH.

In a third aspect, the invention relates to method for operating a well component by means of a tool assembly according to the second aspect of the invention, the method comprising the steps of:

- activating the two or more rams so as to create a first sealed space around the inlets at the first portion of the tool in the cavity of the BOP;
- pressurising the first sealed space through the first feedthrough in the BOP, whereby one or more of the hydraulic actuators on the well component may be operated by fluid communication with the first sealed space;
- letting fluid return from the one or more actuators on the well component flow through the one or more return lines to the one or more outlets and optionally into the central bore of the tool.

In a fourth aspect the invention relates to a method for operating a well component by means of a downhole tool assembly according the second aspect of the invention, the method comprising the steps of:

- establishing a seal below the well component in the well,
- activating the lowermost of the two or more rams so as to create a second sealed space around the inlets at the second portion of the tool in the BOP cavity;
- pressurising the second sealed space through the second feedthrough in the BOP, whereby one or more of the hydraulic actuators on the well component may be operated via fluid communication with the second sealed space;
- letting fluid return from the one or more actuators on the well component flow through the one or more return lines to the one or more outlets and into the central bore of the tool.

BRIEF DESCRIPTION OF THE DRAWINGS

In the following is described an example of a preferred embodiment illustrated in the accompanying drawings, wherein.

DETAILED DESCRIPTION OF THE DRAWINGS

Figure 1:
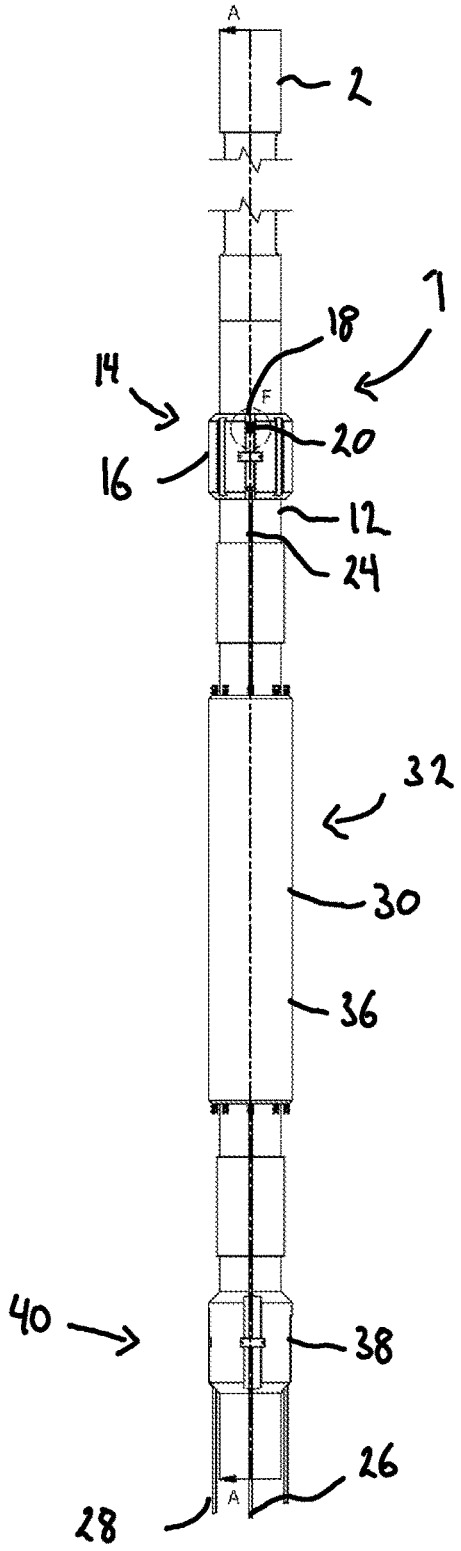
FIG. 1 shows a tool according to the present invention is a front view.
Figure 2:
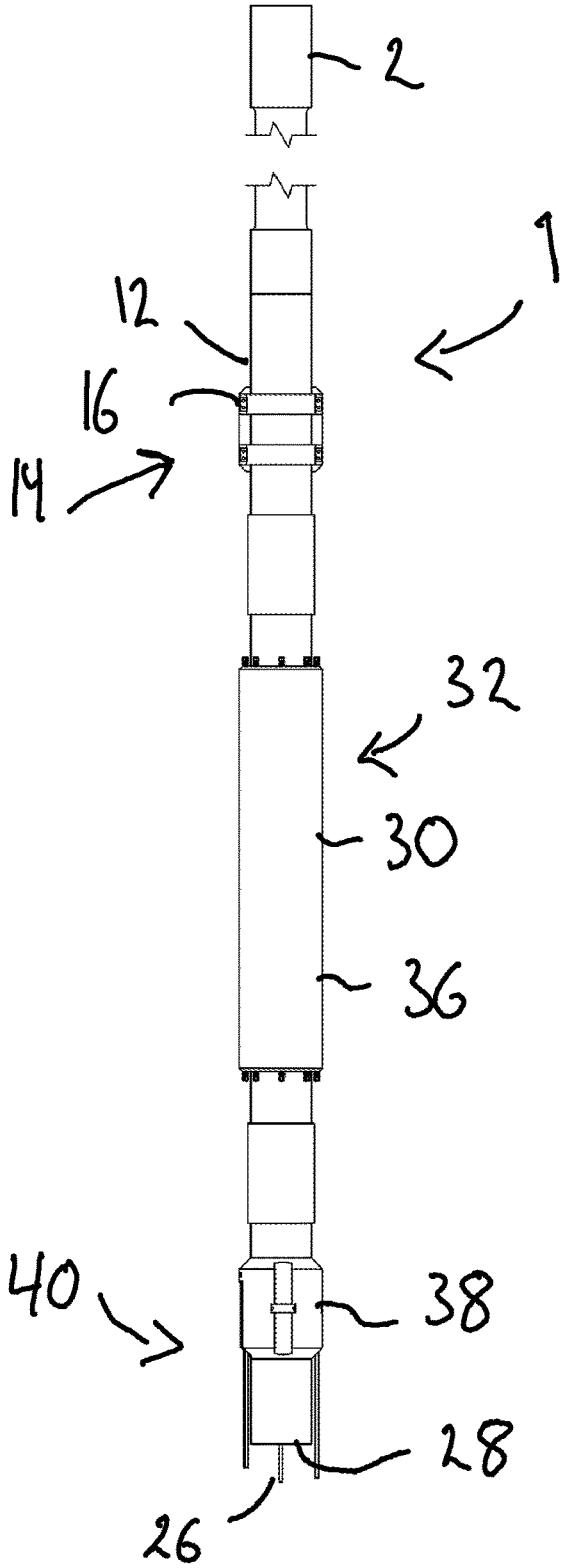
FIG. 2 shows the tool from FIG. 1 in rear view.
Figure 3:
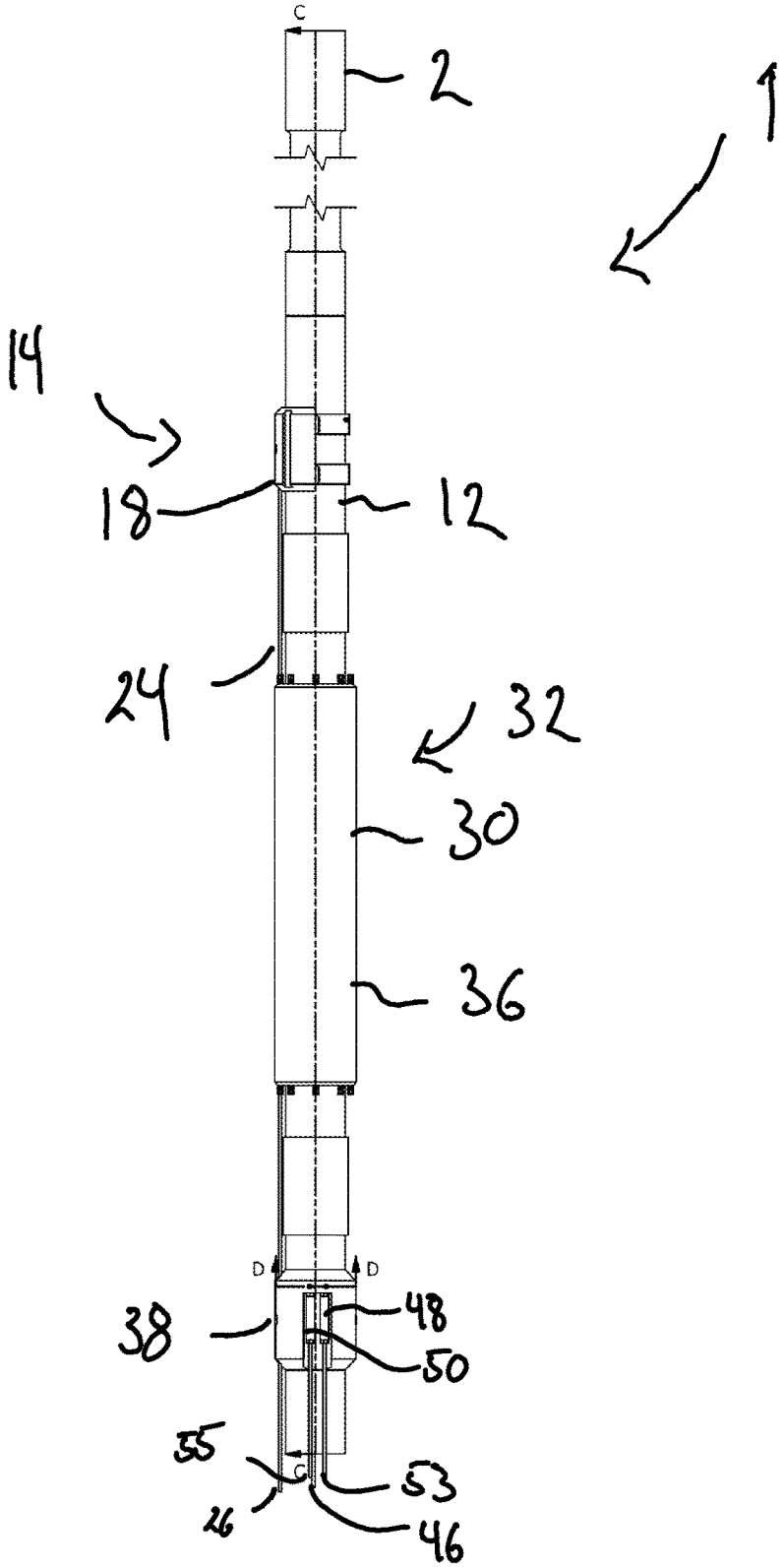
FIG. 3 shows the tool from FIG. 1 in a side view.
Figure 4:
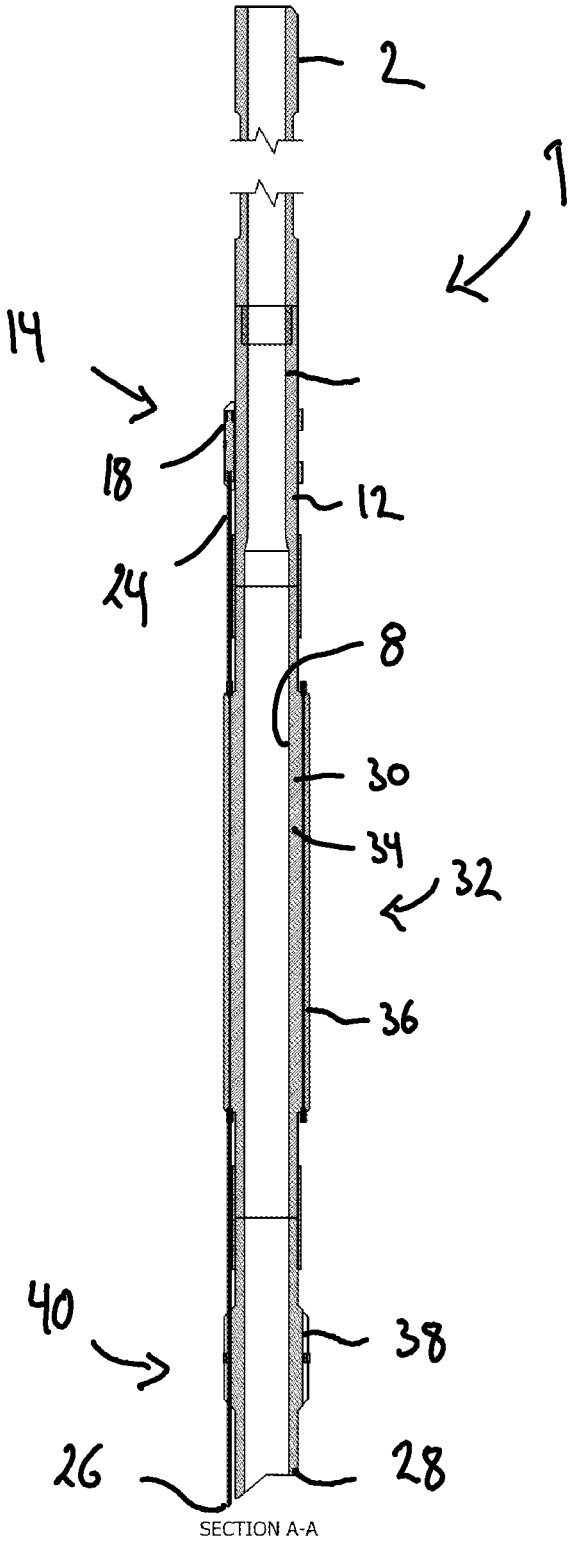
FIG. 4 shows a longitudinal cross-section of the tool through the line A-A from FIG. 1.
Figure 5:
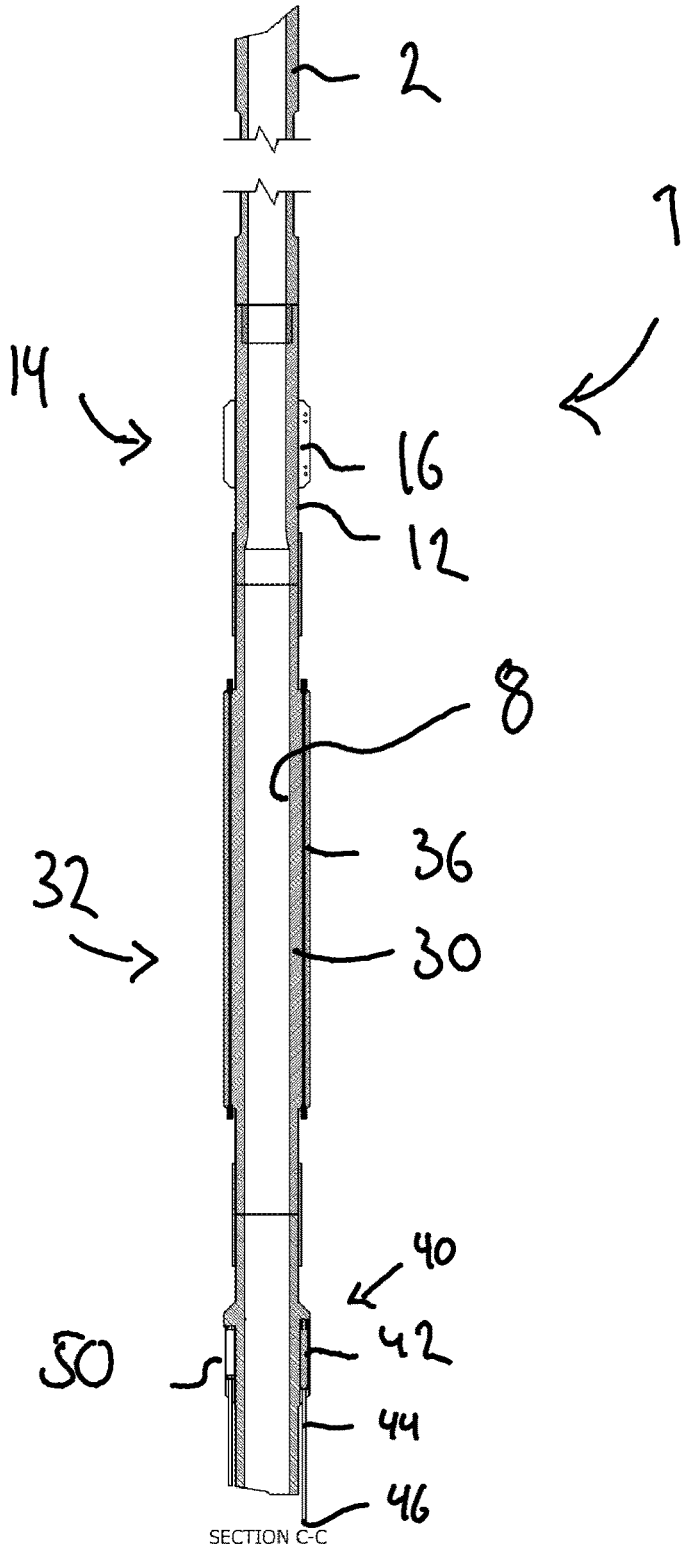
FIG. 5 shows a longitudinal cross-section of the tool through the line C-C from FIG. 3.
Figure 6:
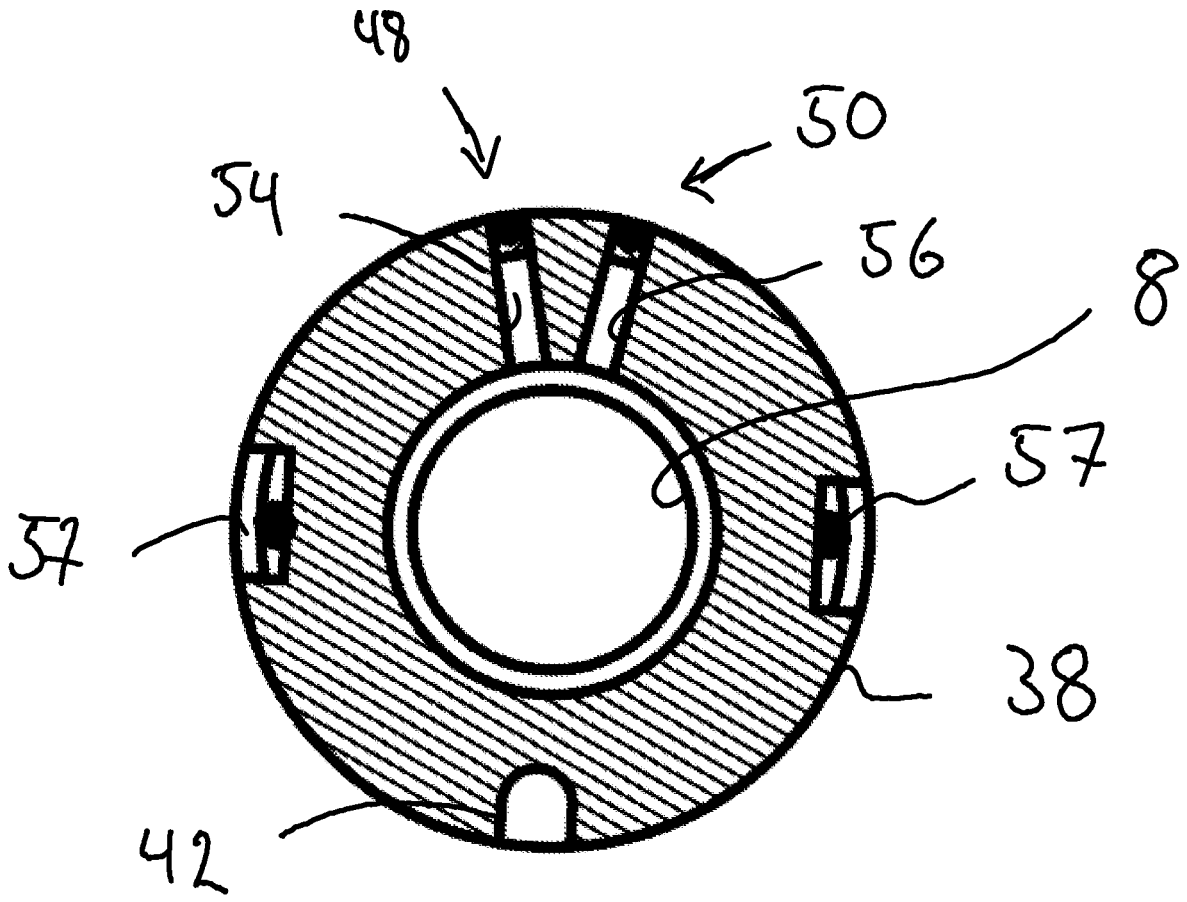
FIG. 6 shows perpendicular a cross-section of the tool through the line D-D from FIG. 3
Figure 7:
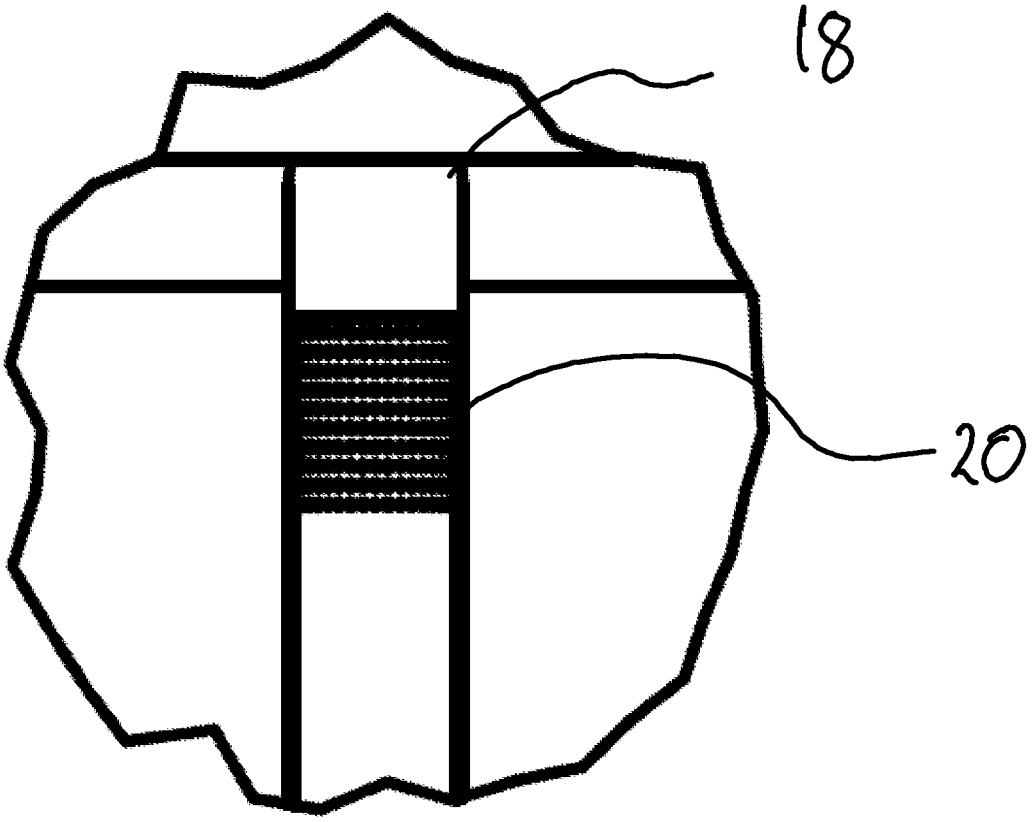
FIG. 7 shows, in an enlarged view, detail F from FIG. 1.

In the following the reference numeral 1 will be used to denote a tool according to the first aspect of the invention, whereas reference numeral 10 will be used to denote a tool assembly according to the second aspect of the invention. Identical reference numerals will be used to identify identical or similar features in the drawings, which are shown schematically and simplified, and in which various features are not necessarily drawn to scale.

Figure 8:
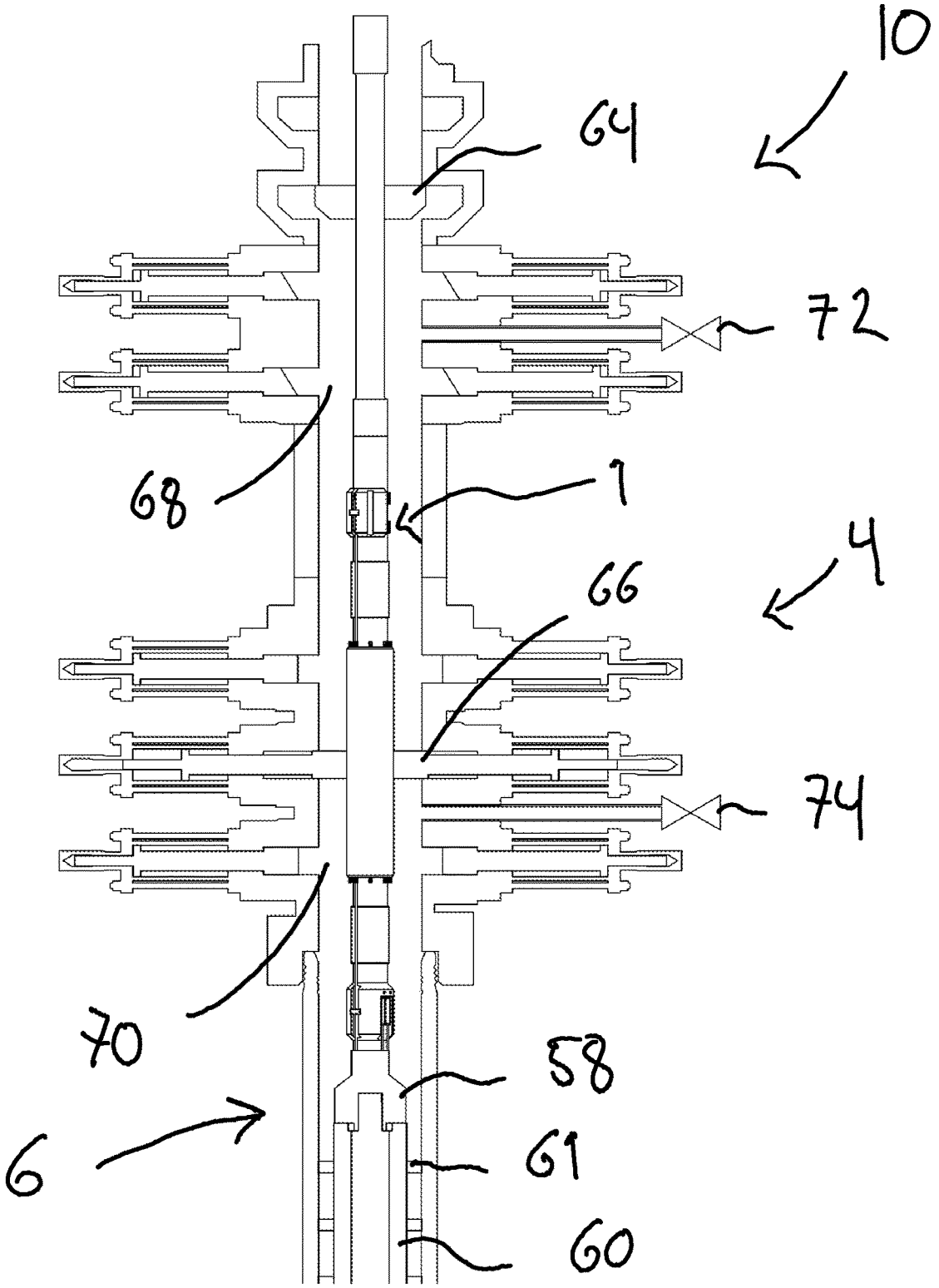
FIG. 8 shows a tool assembly according to the invention.
Figure 9:
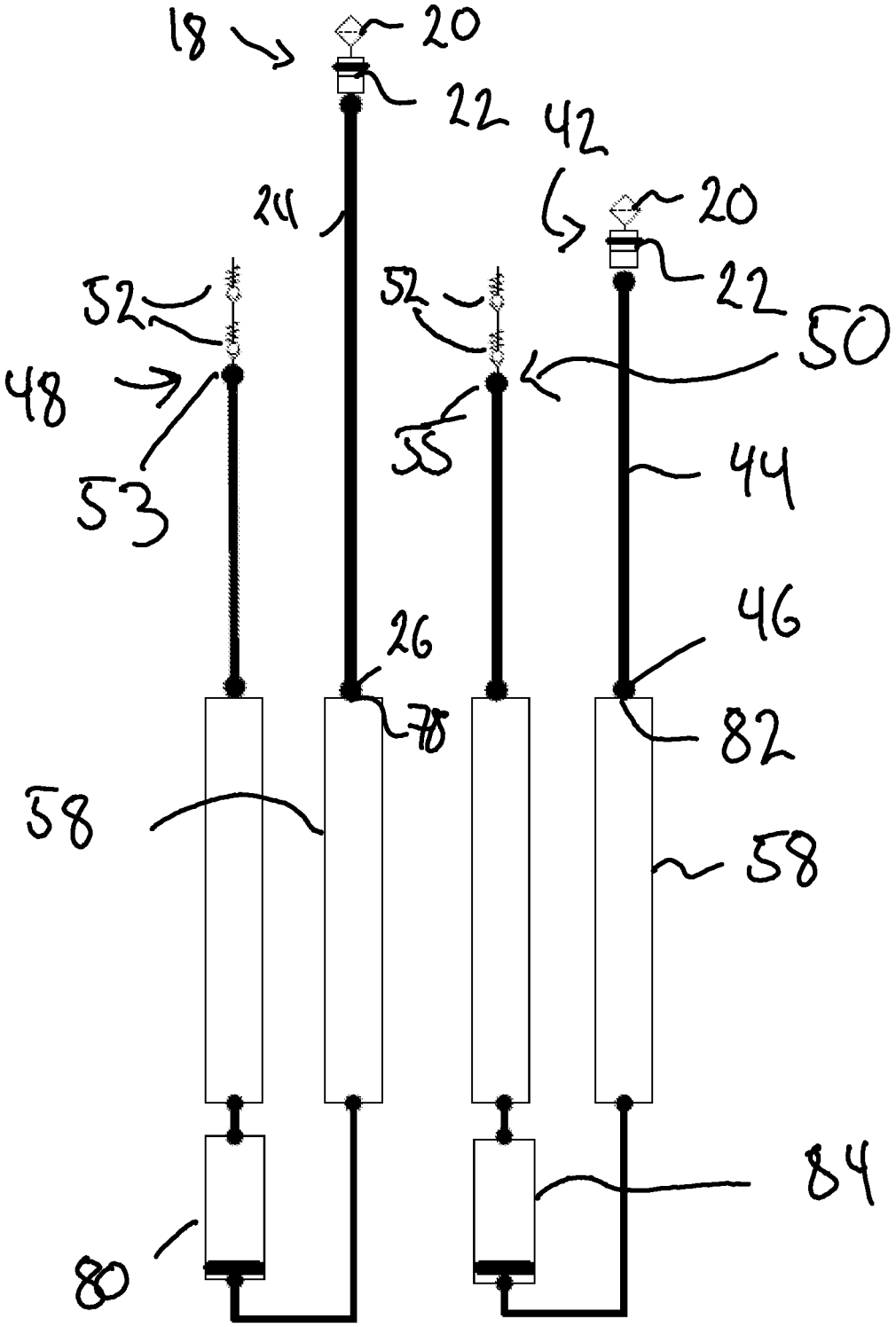
FIG. 9 shows a simplified hydraulic connection diagram of the tool assembly according to the invention.

FIGS. 1-7 show an embodiment of tool 1 according to the invention. The tool is adapted to be run on a pipe string 2, here in the form of a drill pipe, and deployed in a blowout preventer (BOP) 4 above a wellhead 6 as shown in FIG. 8 and discussed below. The tool is formed with an axial extending bore 8, as can e.g. be seen in FIGS. 4-6. The tool 1 is further provided with crossover sub 12 for connecting the remainder of the tool 1 to the pipe string 2. Around the crossover sub 12, which is provided at a first portion 14 of the tool 1, is clamped a carrier clamp 16. The carrier clamp 16 includes a first inlet 18 which in the shown embodiment is provided with a filter 20 for cleaning hydraulic fluid, as best seen in the enlarged view in FIG. 7. In addition or as an alternative, the inlet 18 may also be provided with a flow restricting member, such as a burst disc 22, as shown in FIG. 9, and/or a not shown check valve. From the inlet 18 at the first portion 14 of the tool 1 extends a first inlet line 24 axially along the tool 1 to an inlet termination 26 at a lower end 28 of the tool 1. In the shown embodiment, a bypass mandrel 30 is provided around a mid-portion 32 of the tool 1, where the inlet line 24 from the inlet 18 at the first portion 14 of the tool extends inside a wall 34 of the mandrel 30, leaving the bypass mandrel 30 with a slick, circular outer surface 36. The tool 1 further provided with an injection mandrel 38 at a second portion 40 of the tool 1, where the second portion 40 is below the first portion 14 in a position of use and where the mid-portion 32 with the bypass mandrel 30 separates the first and second portions 14, 40 of the tool 1. In the shown embodiment, the injection mandrel is formed with an inlet 42 from which an inlet line 44 extends to a termination 46 at the lower end 28 of the tool. The injection mandrel also includes two outlets 48, 50 each of which is provided with one or more return valves, as indicted as check valves 52 in FIG. 9. The outlets 48, 50 communicate with the central, axial bore 8 of the tool 1 through radial bores 54, 56 in the injection mandrel 38. The injection mandrel is also formed with two bypass grooves 57 for inlet lines 24 from the first portion 14 of the tool 1, though only one inlet line 24 from the first portion 14 of the tool is used in the shown embodiment.

FIG. 8 shows an embodiment of a tool assembly 10 according to the second aspect of the invention. In addition to the tool 1, the tool assembly 10 also includes a well component 58 to which the tool 1 is connected. In the shown embodiment, the tool 1 is shown connected to a tubing hanger running tool (THRT), thus constituting the well component which it is adapted to control. The THRT 58 is further latched to a tubing hanger (TH) 60, which is then indirectly controlled by the tool assembly 10 through the THRT 58. The tool assembly 10 also includes the pipe string 2 to which the tool 1 is connected and deployed and the blowout preventer (BOP) 4. In operation, as shown in FIG. 8, the tool 1 is placed inside the BOP 4. The BOP 4 is provided with several rams, here exemplified with annular (ram) 64 and a pipe ram 66, both of which are operable between a retracted position and an active, sealing position, where the latter is shown in FIG. 8. In the shown embodiment, the annular 64 is adapted to engage the pipe string 2 in a sealing engagement above the first portion 14 of the tool and where the pipe ram 66 is adapted to engage the bypass mandrel 30 in sealing engagement between the first and second portions 14, 40 of the tool 1. When both the annular 64 and pipe ram 66 are in their active, sealing position, a first cavity 68 is formed inside the BOP 4 between the annular 64 and pipe ram 66. In the shown embodiment the TH 60 forms a seal of its own below the THRT 58 by means of a plurality of seals 61 positioned in complimentary formed not shown grooves in the wellhead 6. The seals 61 may be elastomers or metal-metal seals that enter into a sealing position when the TH 60 is landed in the wellhead 6 as will be understood by a person skilled in the art. Below the pipe ram 66, when in its active, sealing position, a second cavity 70 is thereby formed inside the BOP 4. The annular 64 does not need to be in its active, sealing position when pressuring the second cavity 70. A first feedthrough 72 provides hydraulic communication from the outside to the first cavity 68, whereas a second feedthrough 74 provides hydraulic communication from outside to the second cavity 70. The feedthroughs may typically be kill and choke lines already present in the BOP 4.

When it is desired to activate a first hydraulic function in the THRT 58, such as to install the TH 60 in the well, one of the cavities 68, 70 may be pressurized by supply of hydraulic fluid through a respective feedthrough 72, 74. In an exemplary embodiment, the first cavity 68 may be pressurized, whereby not shown hydraulic fluid flows into the inlet 18 at the first portion 14 of the tool 1 cleaned by filter 20, as indicated in FIG. 9. Further the hydraulic fluid flows in the inlet line 24 in the bypass mandrel 30, through the termination 26 and into a first inlet 78 on the THRT 58. In the THRT 58 the hydraulic fluid acts on a first actuator 80 to force the THRT 58 to lock the TH 60 mechanically in the wellhead 6, where the TH as such is not shown in FIG. 9. The return flow from the opposite side of the actuator/cylinder 80 flows into the first outlet 48, through outlet termination 53, check valves 52 and the first radial bore 54 in the injection mandrel 38 and into the axial bore 8 of the tool 1. The check valves 52 prevent backflow of hydraulic fluid.

Similarly, when desired to activate a second hydraulic function in the THRT 58, such as to unlatch it from the TH 60 in the well, the second cavity 70 may be pressurized by the second feedthrough 74. Hydraulic fluid flows from inlet 42 in the injection mandrel 38 at the second portion of the tool 1, through the second inlet line 44 and termination 46 and into a second inlet 82 in the THRT 58. In the THRT 58 the hydraulic fluid acts on a second hydraulic actuator 84 to release/unlatch the THRT 58 from the TH 60 (not shown in FIG. 9) whereafter the tool 1 may be pulled out of the well on the pipe string 2. The return flow from the opposite side of the actuator/cylinder 84 flows into the outlet 50, though outlet termination 55 and check valves 52, through the second radial bore 56 in the injection mandrel 38 and into the axial bore 8 of the tool 1. Check valves 52 prevent backflow of hydraulic fluid. In an alternative embodiment, the first cavity 68 may be pressurized to activate unlatching of the THRT 58 from the TH 60, while the second cavity 70 may be pressurized to activate locking of the TH 60 in the wellhead 6. Similarly, the tool assembly 10 may also be used to run an opposite process, i.e. to latch the THRT 58 to the TH 60 and to unlock the TH 60 to the wellhead 6. This may be done by reconnecting the tool 1 to the THRT 58 when the tool is topside, so that inlets (not shown) on the THRT 58 for latch and unlock are connected to the inlet terminations 26, 46. Alternatively, the tool may be provided with two or more inlets at both the first and second portions, where different inlets at the different portions may be activable at different operating pressures, such as by burst discs with different breaking pressures. In such a case it may be possible to run an opposite operation without retrieving and reconnecting the tool topside.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. A tool for operating a well component, the tool being arranged for deployment on a pipe string and for being positioned in a central, axially extending cavity of a blowout preventer (BOP), the tool being formed with a central, axially extending bore and comprising:

a first portion and a second portion, the first portion being arranged above the second portion in a position of use;

one or more inlets at the first portion of the tool;

a first set of one or more inlet lines extending axially along tool from the one or more inlets at the first portion of the tool and to one or more inlet line terminations at a lower end of the tool, wherein the tool further comprises:

one or more inlets at the second portion of the tool;

a second set of one or more inlet lines extending from the one or more inlets at the second portion of the tool and to one or more inlet line terminations at the lower end of the tool;

one or more outlets provided with outlet valves and one or more return lines extending from one or more return line terminations at the lower end of the tool to the one or more outlets, wherein the inlet and return line terminations are adapted to mate with correspondingly fitting inlets and outlets, respectively, on a well component, wherein the first and second portions are separated by a bypass mandrel having a slick outer surface; and the outlet valves ensure that fluids can only flow into the well component from the inlet lines and out from the well component into the return lines of the tool.

2. The tool according to claim 1, wherein the one or more outlets are in flow communication with the central, axially extending bore of the tool.

3. The tool according to claim 1, wherein one or more of the inlets at the first and/or second portion of the tool is/are provided with an inlet flow restricting member such as a burst disc and/or a check valve.

4. The tool according to claim 1, wherein one or more of the inlets at the first and/or second portion of the tool is/are provided with a filter for filtering hydraulic fluid.

5. The tool according to claim 1, wherein the one or more inlets at the second portion of the tool and one or more of the outlets are provided in a common injection mandrel.

6. The tool according to claim 1, wherein the one or more inlets at the first portion of the tool are provided in a carrier clamp.

7. The tool according to claim 6, wherein the tool comprises a crossover sub for connecting the remainder of the tool to a pipe string, and wherein the carrier clamp is clamped to the crossover sub.

8. The tool according to claim 7, wherein the one or more inlet lines extending from the one or more inlets at the first portion of the tool extend in one or more internal bypass bores in the bypass mandrel.

9. The tool according to claim 1, wherein the tool is provided with a reservoir with clean fluid.

10. A tool assembly comprising:

the tool according to claim 1;

a well component to which the tool is connected, the inlet and return line terminations at the lower end of the tool being mated with correspondingly fitting inlets and outlets, respectively, on the well component, the well component including one or more hydraulic actuators controllable via the inlet and return lines;

a pipe string to which the tool is connected;

a blowout preventer (BOP) in which the tool is positioned in a central, axially extending cavity, the BOP comprising:

two or more rams moveable between a retracted position and an active position, the two or more rams being provided with a axial distance therebetween; and two or more feedthroughs for providing fluid communication with the central cavity of the BOP from the outside of the tool assembly; wherein a first feedthrough is provided between the first and second rams and a second feedthrough is provided below the second ram; and wherein:

the tool is positioned in the central cavity of the BOP so that the first ram, when in its active position, is sealing against the tool or pipe string above the one or more inlets at the first portion of the tool, and a second ram, when in its active position, is sealing against the tool between the first and second portions of the tool.

11. The tool assembly according to claim 10, wherein the two or more rams include an annular ram and a pipe ram.

12. The tool assembly according to claim 10, wherein the well component includes a tubing hanger running tool, and wherein the tool assembly is adapted to install and uninstall a tubing hanger in and from a well and to unlatch and latch the tubing hanger running tool from and to the tubing hanger.

13. The tool assembly according to claim 10, wherein at least one hydraulic actuator in the well component is connected to an inlet line from the first set of inlet lines and a second hydraulic actuator on the well component is connected to an inlet line of the second set of inlet lines.

14. A method for operating a well component by means of the tool assembly according to claim 10, wherein the method comprises the steps of:

activating the two or more rams so as to create a first sealed space around the inlets at the first portion of the tool in the cavity of the BOP;

pressurizing the first sealed space through the first feedthrough in the BOP, whereby one or more of the hydraulic actuators on the well component may be operated by fluid communication with the first sealed space;

letting fluid return from the one or more actuators on the well component flow through the one or more return lines to the one or more outlets and optionally into the central bore of the tool.

15. A method for operating a well component by means of the tool assembly according to claim 10, wherein the method comprising the steps of:

establishing a seal below the well component in the well, activating the lowermost of the two or more rams so as to create a second sealed space around the inlets at the second portion of the tool in the BOP cavity;

pressurizing the second sealed space through the second feedthrough in the BOP, whereby one or more of the hydraulic actuators in the well component may be operated via fluid communication with the second sealed space;

letting fluid return from the one or more actuators on the well component flow through the one or more return lines to the one or more outlets and optionally into the central bore of the tool.

16. The tool according to claim 2, wherein one or more of the inlets at the first and/or second portion of the tool is/are provided with an inlet flow restricting member such as a burst disc and/or a check valve.

17. The tool assembly according to claim 11, wherein the well component includes a tubing hanger running tool, and wherein the tool assembly is adapted to install and uninstall a tubing hanger in and from a well and to unlatch and latch the tubing hanger running tool from and to the tubing hanger.

* * * * *